US008590522B2

(12) United States Patent
Khoshnood et al.

(10) Patent No.: US 8,590,522 B2
(45) Date of Patent: Nov. 26, 2013

(54) BOW STABILIZING AND SHOCK DAMPENING SYSTEMS AND METHODS

(76) Inventors: Bahram Khoshnood, Cumming, GA (US); Michael Teems, Rockmart, GA (US)

( * ) Notice: Subject to any disclaimer, the term of this patent is extended or adjusted under 35 U.S.C. 154(b) by 433 days.

(21) Appl. No.: 12/950,995

(22) Filed: Nov. 19, 2010

(65) Prior Publication Data

US 2012/0125308 A1 May 24, 2012

(51) Int. Cl.
*F41B 5/20* (2006.01)
*F41B 5/14* (2006.01)

(52) U.S. Cl.
CPC ..... *F41B 5/1426* (2013.01)
USPC ..... 124/89; 124/86; 124/88

(58) Field of Classification Search
CPC ..... F41B 5/1426
USPC ..... 124/86, 88, 89
See application file for complete search history.

(56) References Cited

U.S. PATENT DOCUMENTS 3,342,172 A * 9/1967 Sanders ..... 124/23.1
3,670,712 A * 6/1972 Izuta ..... 124/89
4,085,832 A * 4/1978 Gaines et al. ..... 188/268
4,570,608 A * 2/1986 Masterfield ..... 124/89
4,893,606 A * 1/1990 Sisko ..... 124/89
5,016,602 A * 5/1991 Mizek ..... 124/89
5,339,793 A * 8/1994 Findley ..... 124/89
5,370,104 A * 12/1994 Neie ..... 124/89
5,411,009 A * 5/1995 Thompson et al. ..... 124/89
5,513,622 A * 5/1996 Musacchia, Sr. ..... 124/89
5,735,257 A * 4/1998 Walk ..... 124/89
5,992,403 A * 11/1999 Slates ..... 124/89
6,085,736 A * 7/2000 Osterhues ..... 124/89
6,105,564 A * 8/2000 Suppan ..... 124/23.1
6,298,842 B1 * 10/2001 Sims ..... 124/89
6,382,201 B1 * 5/2002 McPherson et al. ..... 124/89
6,526,957 B1 * 3/2003 Leven ..... 124/89
6,588,414 B2 * 7/2003 McMillan, III ..... 124/89
6,675,793 B1 * 1/2004 Saunders ..... 124/89
6,712,059 B2 * 3/2004 Donovan ..... 124/89
6,718,964 B1 * 4/2004 Graf ..... 124/89
7,290,644 B2 * 11/2007 Miyake ..... 188/379
7,793,645 B2 * 9/2010 Walk et al. ..... 124/89
7,954,481 B2 * 6/2011 Barnard ..... 124/88
8,038,133 B2 * 10/2011 McPherson ..... 267/140.4
8,141,548 B2 * 3/2012 Leven ..... 124/89
8,225,778 B2 * 7/2012 Walk et al. ..... 124/89

* cited by examiner

*Primary Examiner* — Alvin Hunter
*Assistant Examiner* — Alexander Niconovich
(74) *Attorney, Agent, or Firm* — Brient Intellectual Property Law, LLC

(57) ABSTRACT

Bow stabilizer assemblies according to various embodiments may comprise, for example: (1) an elongated housing that is adapted to be selectively attached to a bow; and (2) a plurality of dampener supports that are adapted so that, when the bow stabilizer is attached to the bow, each dampener support maintains a respective dampener in a plane that is substantially perpendicular to the plane of the bow. In various embodiments, the dampener supports are adapted to maintain the dampeners different distances away from a portion of the bow (e.g., the bow's front surface). In particular embodiments, the dampeners may be selectively removed and replaced (e.g., with dampeners of different sizes and/or shapes) without tools. This may allow users to quickly change the configuration and dampening attributes of the bow stabilizing and shock dampening assembly assemblies while the bow stabilizing and shock dampening assembly remains attached to the bow.

30 Claims, 13 Drawing Sheets

BOW STABILIZING AND SHOCK DAMPENING SYSTEMS AND METHODS

BACKGROUND

Bow stabilizers may be used to help hold an archer's bow steady throughout the shot cycle. A typical current bow stabilizer is simply a piece of metal (or other weight) that is attached to the front of a bow. Although such stabilizers can be useful in reducing rotation in the bow through the shot cycle, there is currently a need for improved stabilizers that are adapted for: (1) further reducing rotation in the bow through the shot cycle; (2) reducing torque on the archer's grip through the shot cycle; (3) dampening vibration; and/or (4) reducing the noise generated during the shot cycle.

SUMMARY

A bow stabilizing and shock dampening assembly according to various embodiments comprises: (1) a first dampener support; (2) a second dampener support that is spaced apart from the first dampener support; (3) a support structure that is adapted for connecting the first dampener support to the second dampener support; and (4) an attachment mechanism that is adapted for attaching the bow stabilizing and shock dampening assembly to a bow. In particular embodiments, the support structure, and the first and second dampener supports are adapted so that, when a first dampener is supported by the first dampener support and a second dampener is supported by the second dampener support: (1) the first dampener is disposed within a first plane; (2) the second dampener is disposed within a second plane; and (3) the first plane is at least substantially parallel to the second plane. In various embodiments, the first and second planes are substantially perpendicular to a plane of the bow.

In particular embodiments, the first dampener support is adapted to allow users to, without tools: (A) selectively install a dampener within the first dampener support; and (B) selectively remove the dampener from the first dampener support. Similarly, the second dampener support is adapted to allow users to, without tools: (A) selectively install the dampener within the second dampener support; and (B) selectively remove the dampener from the second dampener support. In various embodiments, the first and second dampener supports are positioned so that, when the bow stabilizing and shock dampening assembly is attached to a bow, the first and second dampener supports maintain a plurality of dampeners in place at different distances from a particular surface of the bow.

BRIEF DESCRIPTION OF THE DRAWINGS

Figure 1:
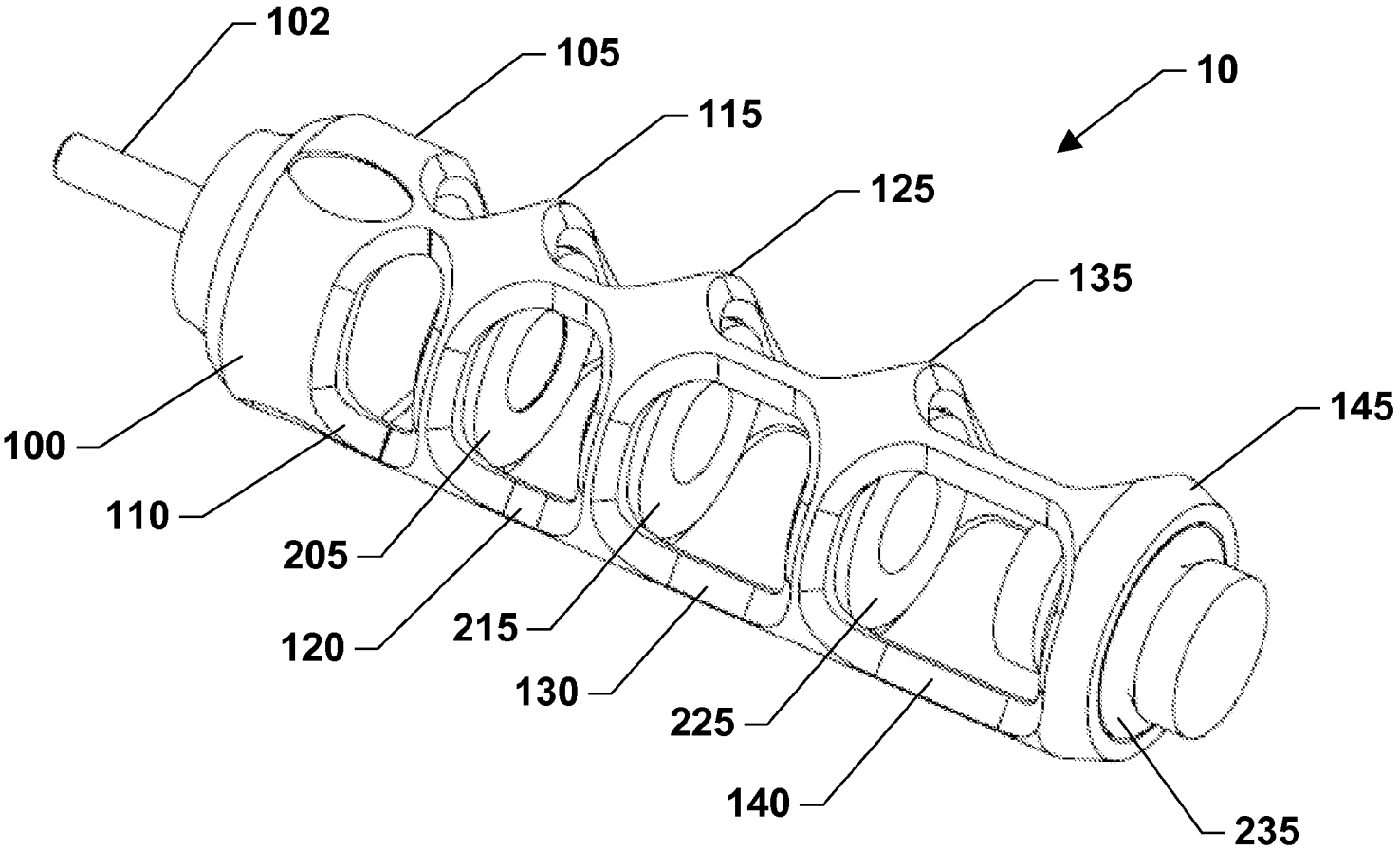

Having thus described various embodiments in general terms, reference will now be made to the accompanying drawings, which are not necessarily drawn to scale, and wherein:

FIG. 1 is a first perspective view of a bow stabilizing and shock dampening assembly according to a particular embodiment.

Figure 2:
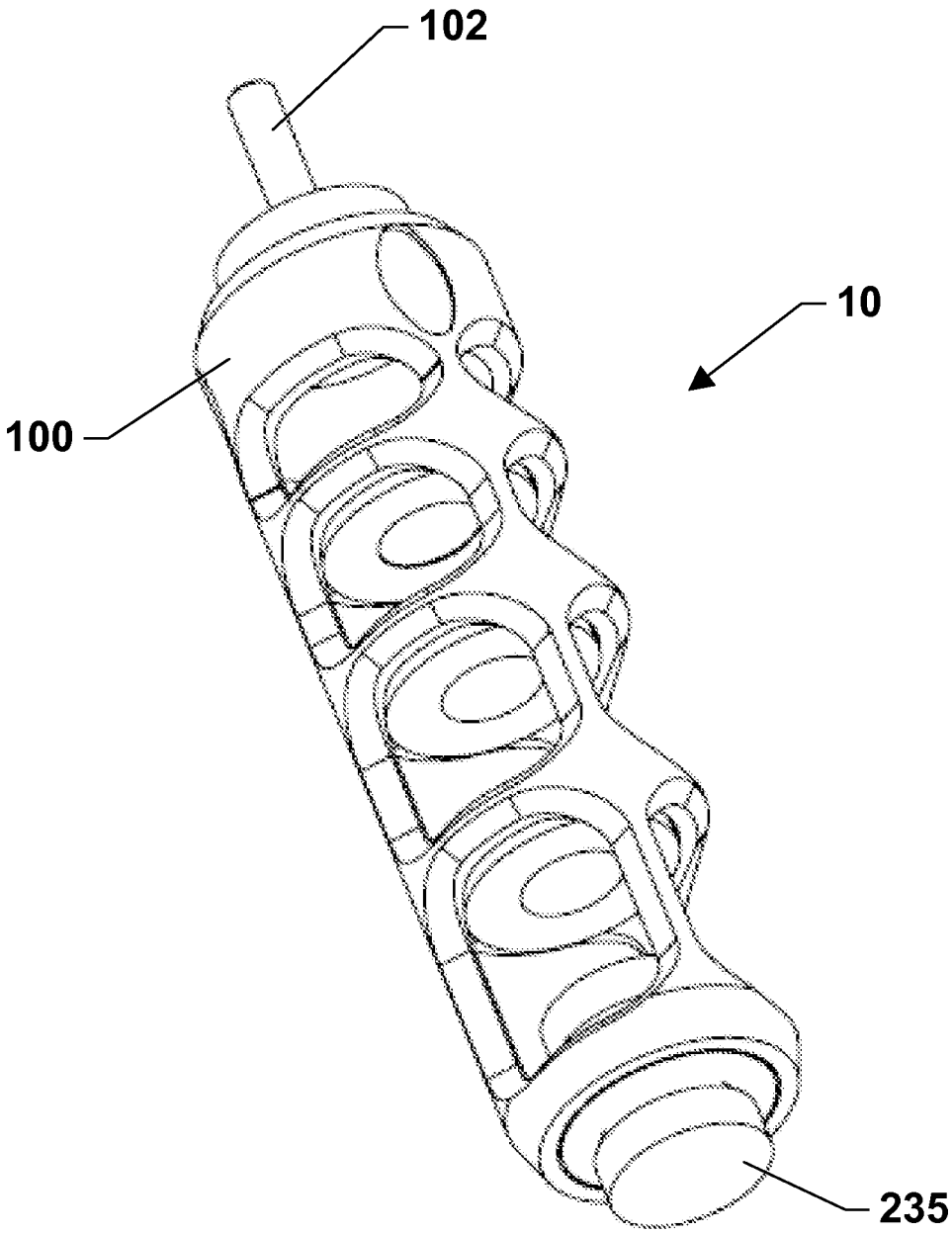

FIG. 2 is a second perspective view of the bow stabilizing and shock dampening assembly of FIG. 1.

Figure 3:
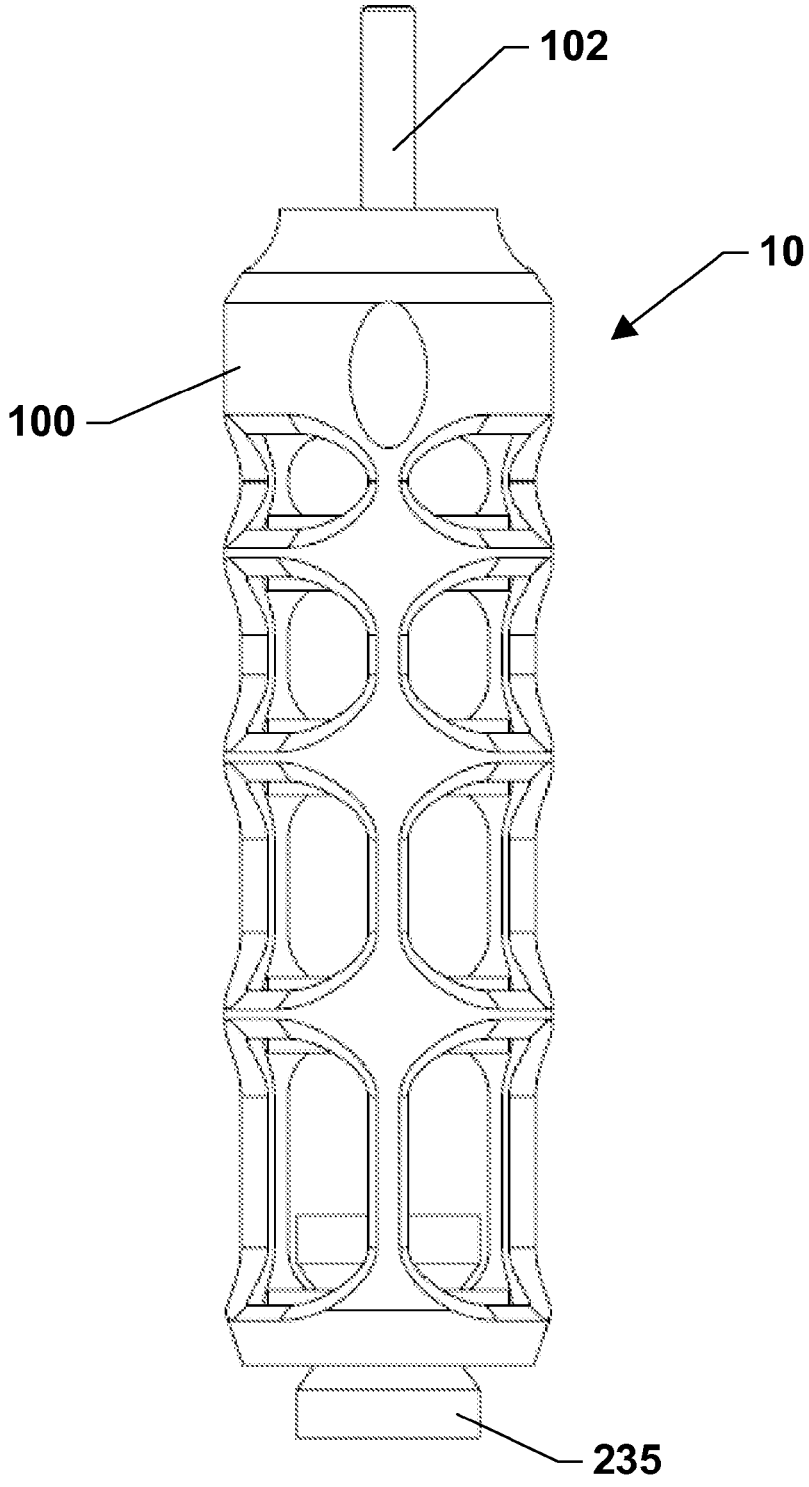

FIG. 3 is a top view of the bow stabilizing and shock dampening assembly of FIG. 1.

Figure 4:
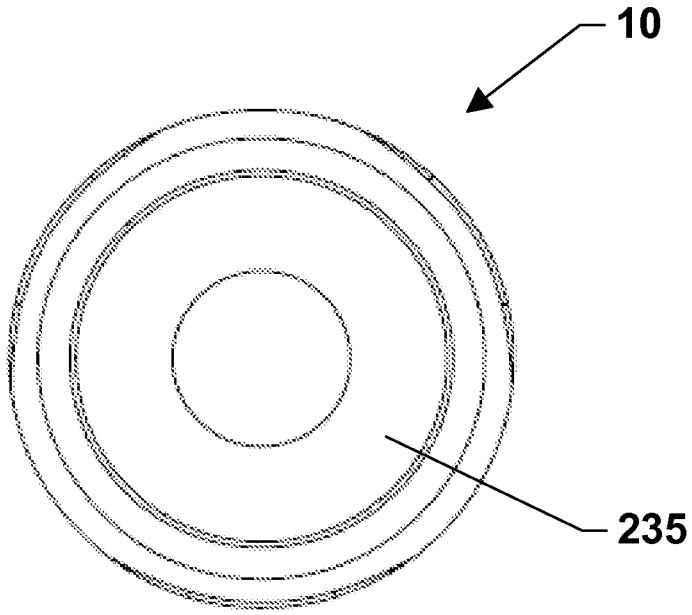

FIG. 4 is an end view of the bow stabilizing and shock dampening assembly of FIG. 1.

Figure 5:
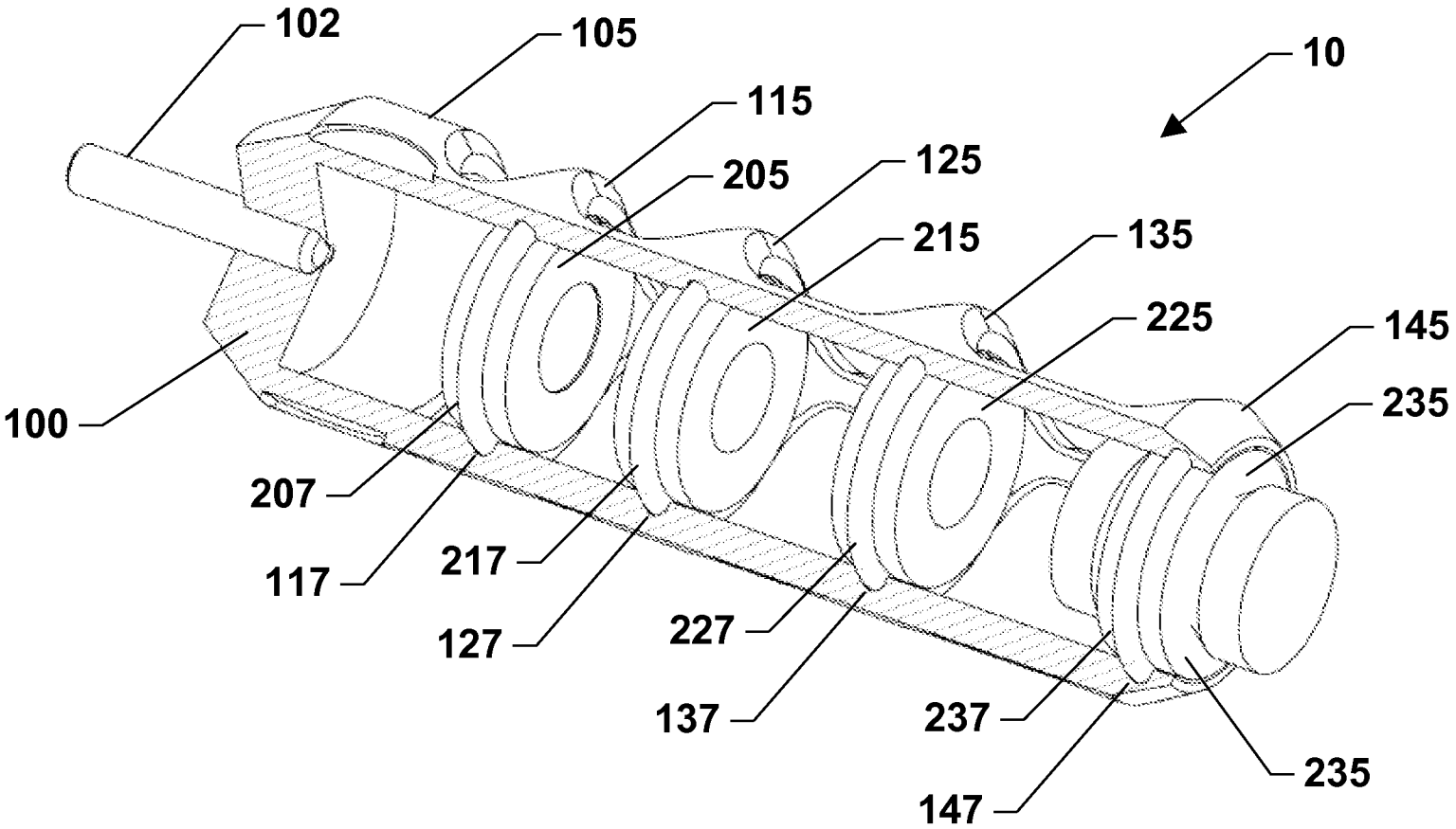
Figure 6:
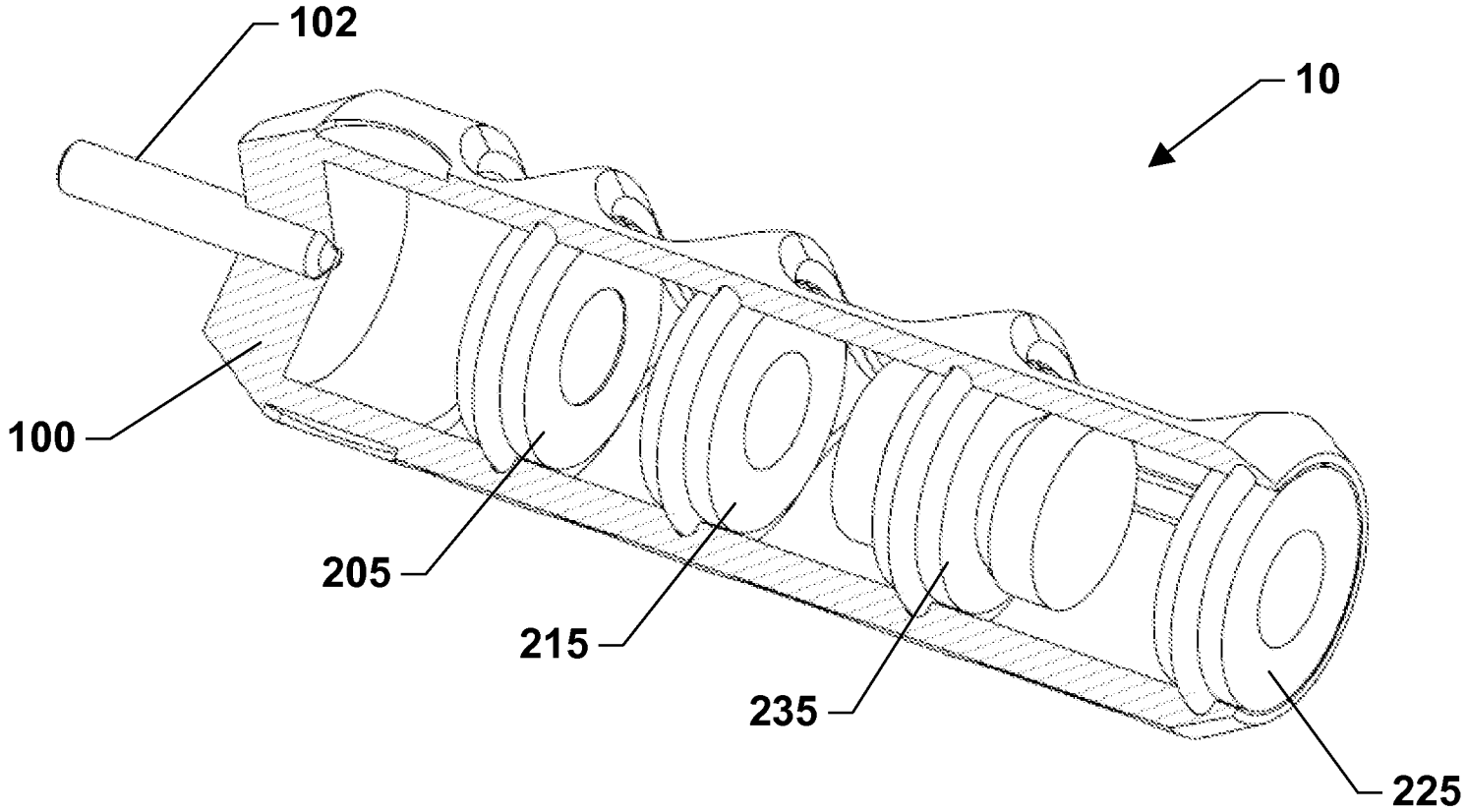

FIGS. 5-6. are perspective cross sectional views of the bow stabilizing and shock dampening assembly of FIG. 1.

Figure 7C:
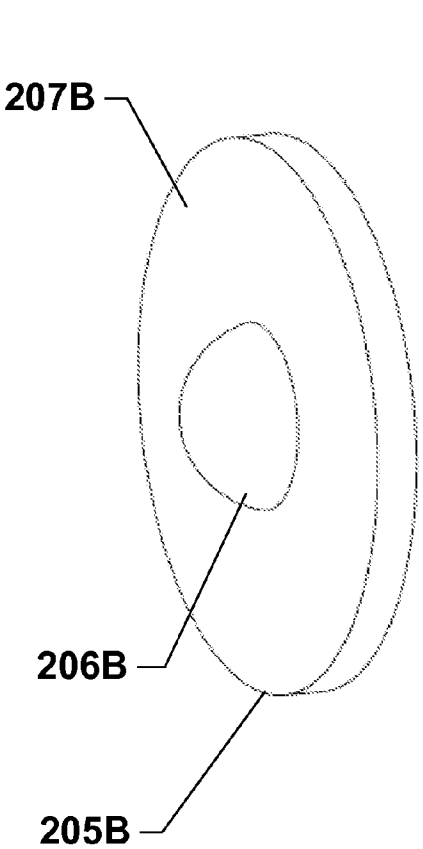
Figure 7B:
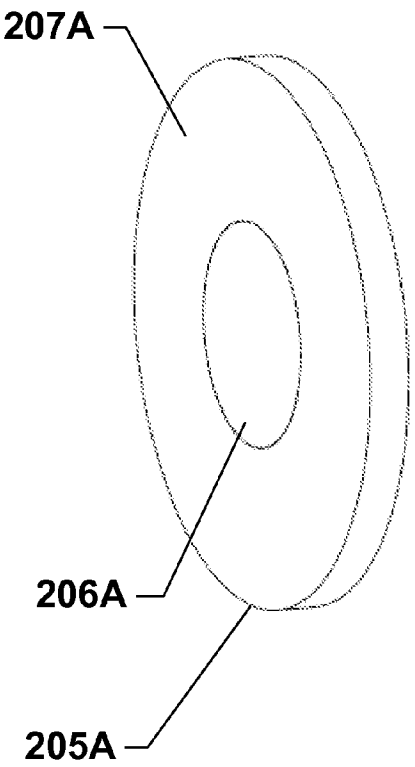
Figure 7A:
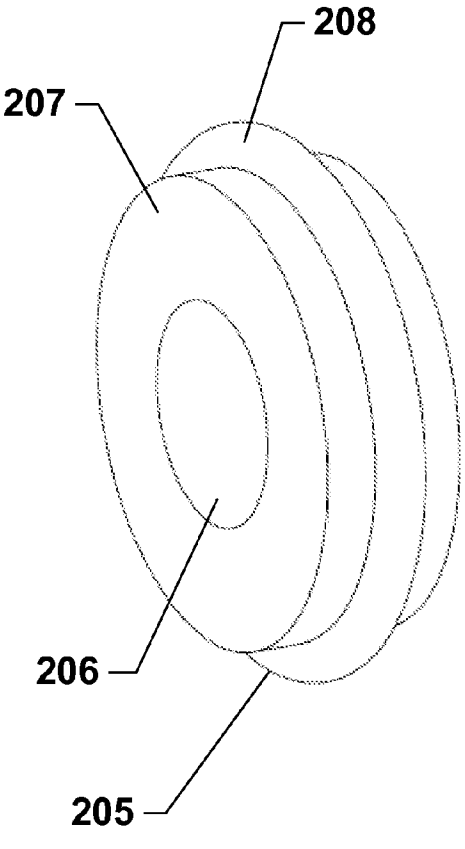

FIGS. 7A-7C are perspective views of dampeners according to various embodiments.

Figure 8:
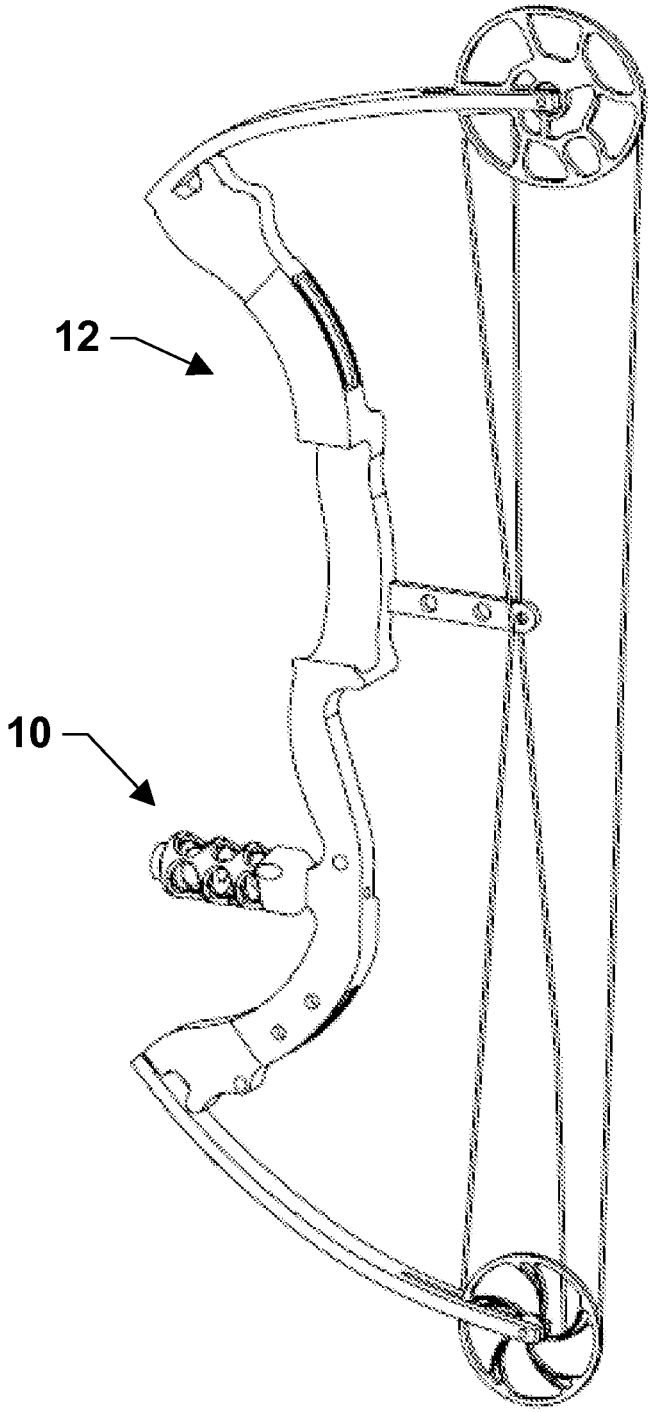

FIG. 8 is a side view of the bow stabilizing and shock dampening assembly of FIG. 1 installed on a bow.

Figure 9:
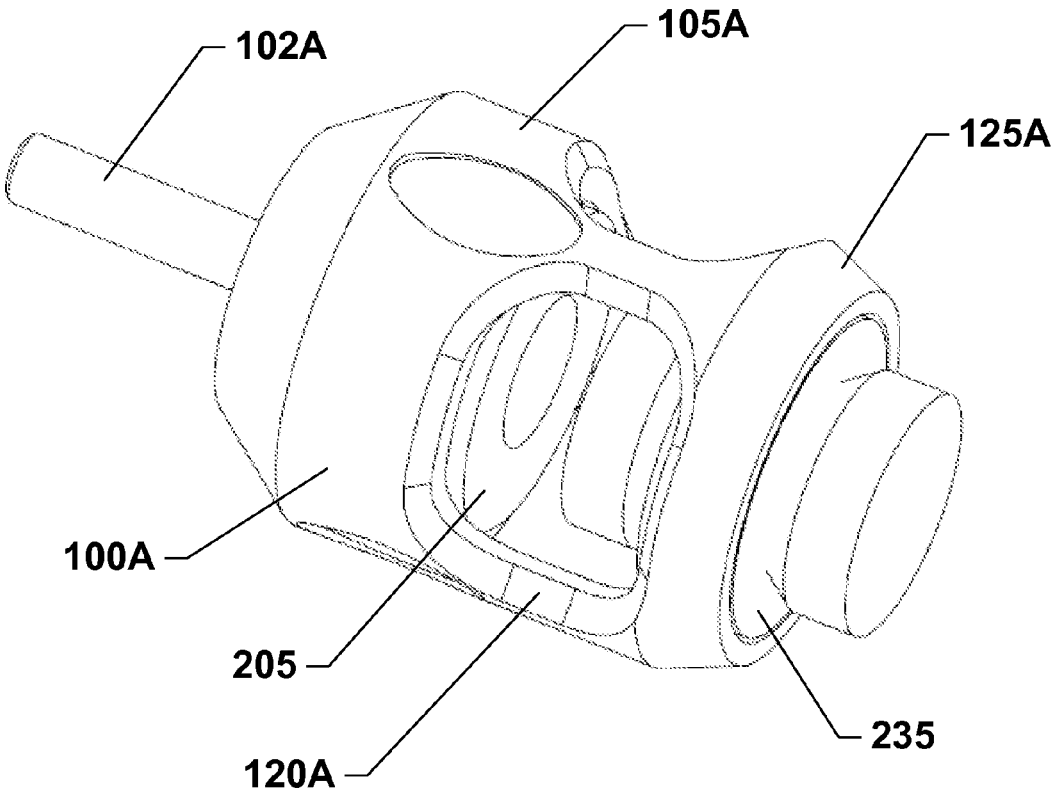

FIG. 9 is a perspective view of a bow stabilizing and shock dampening assembly according to another embodiment.

Figure 10:
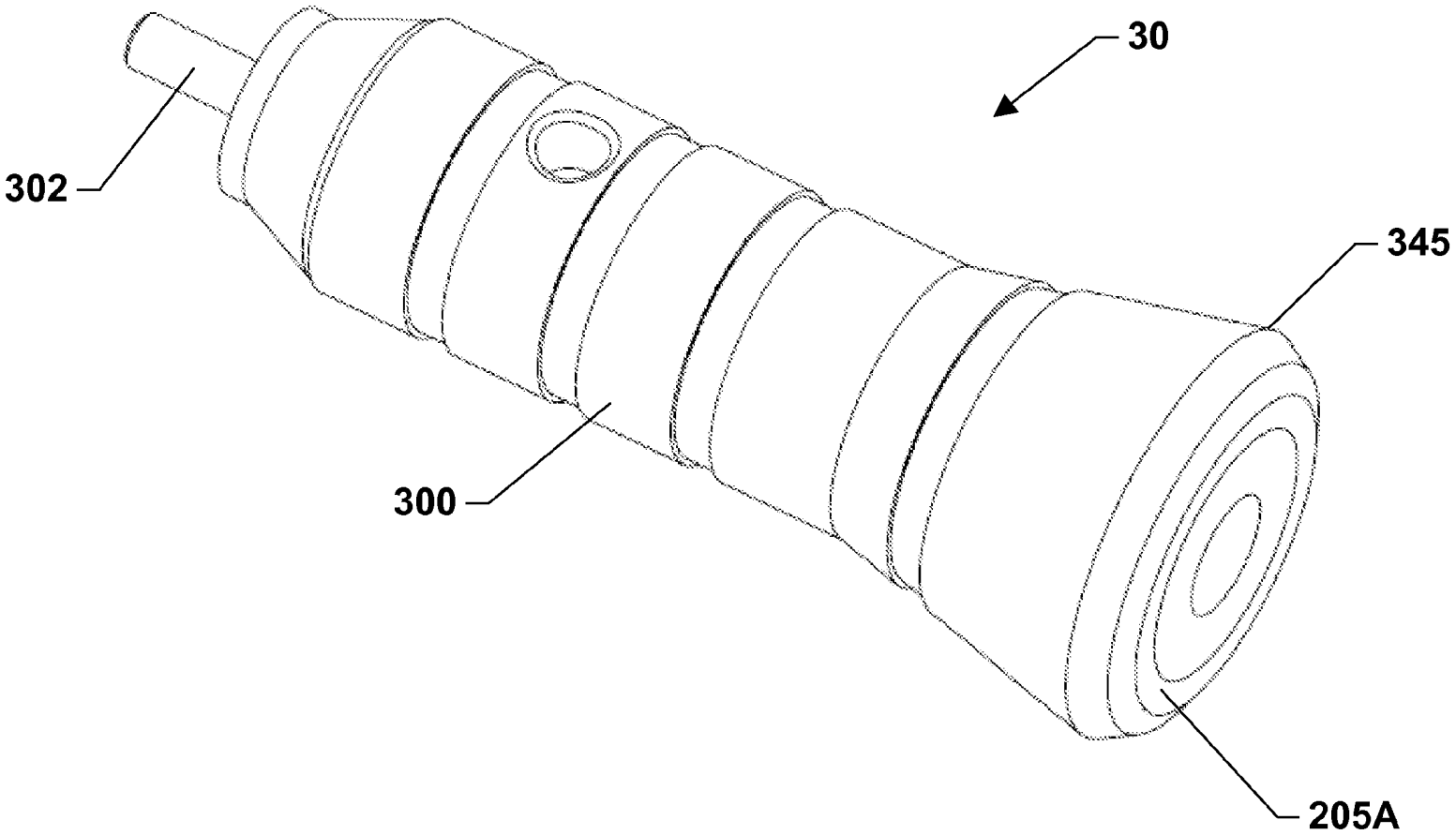

FIG. 10 is a perspective view of a bow stabilizing and shock dampening assembly according to a further embodiment.

Figure 11:
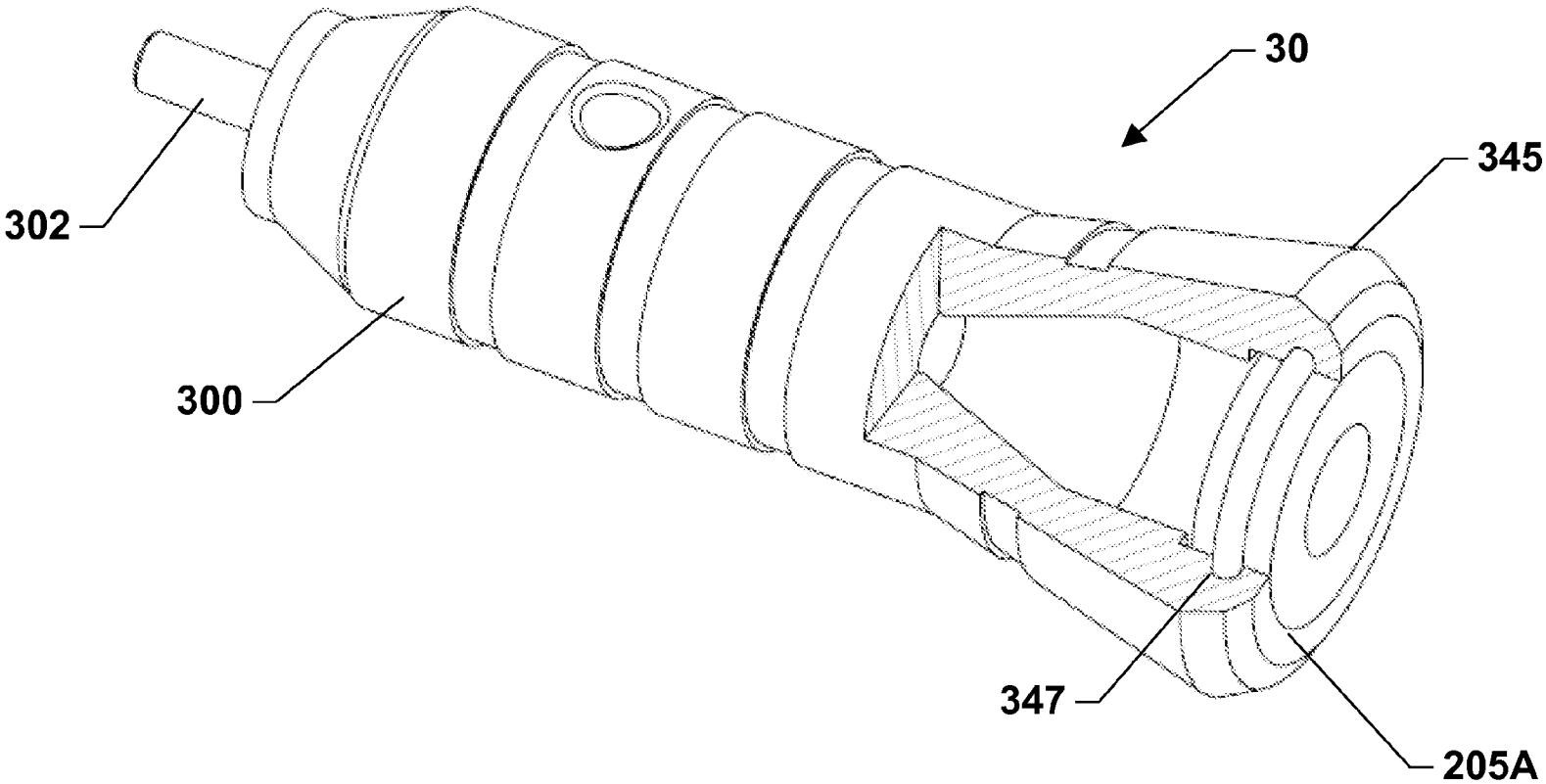

FIG. 11 is a cross-sectional perspective view of the bow stabilizing and shock dampening assembly of FIG. 10.

Figure 12:
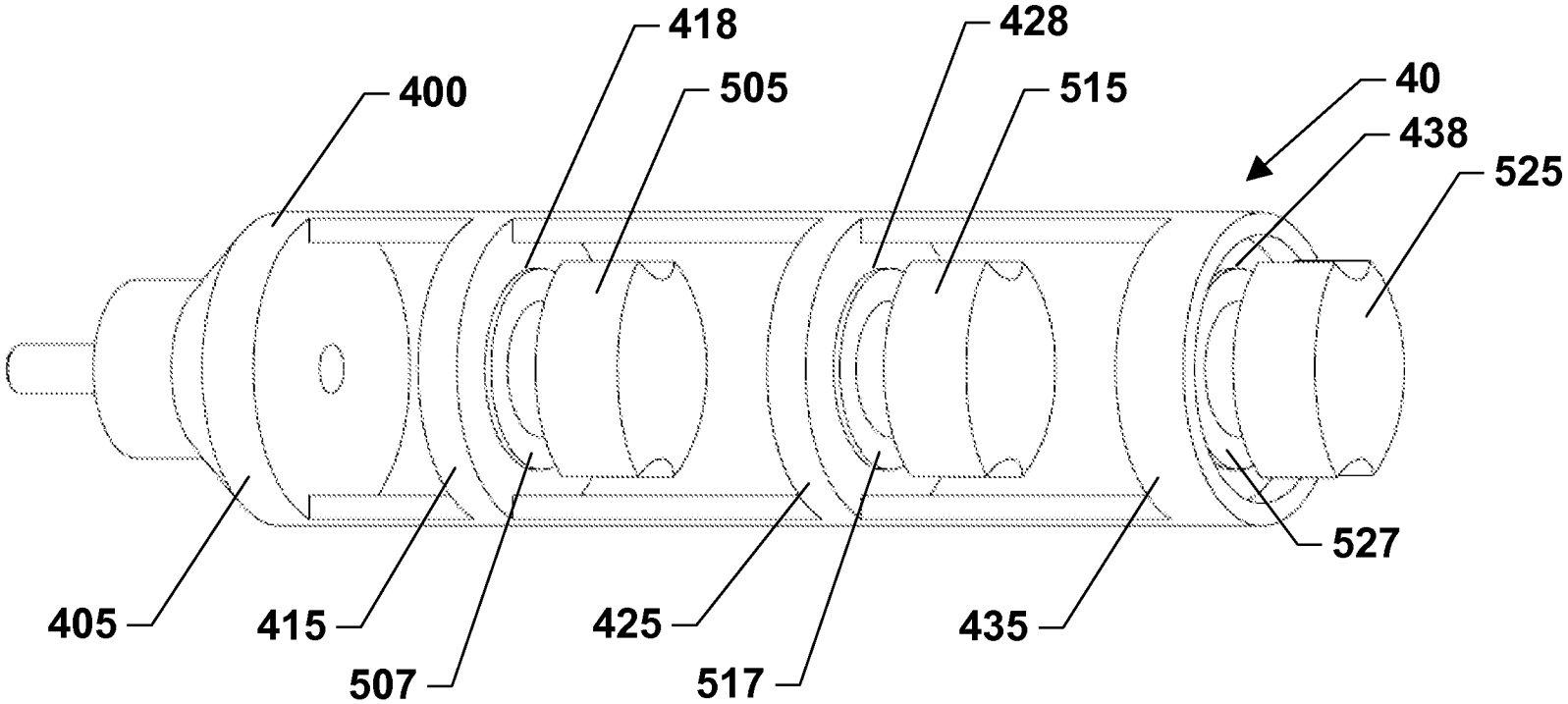

FIG. 12 is a first perspective view of a bow stabilizing and shock dampening assembly according to yet another embodiment.

Figure 13:
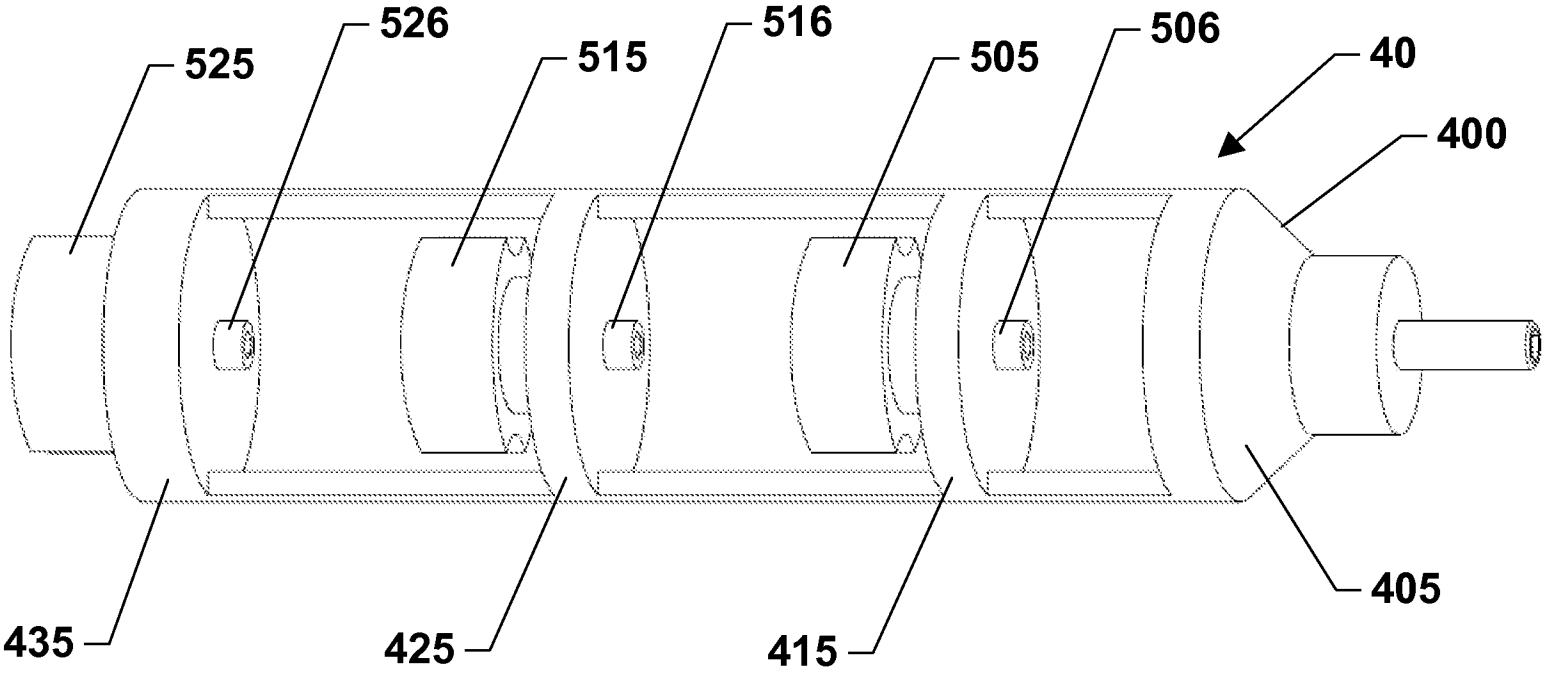

FIG. 13 is a second perspective view of the bow stabilizing and shock dampening assembly of FIG. 12.

DETAILED DESCRIPTION

Various embodiments of the present invention will now be described more fully hereinafter with reference to the accompanying drawings, in which various embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

A bow stabilizing and shock dampening assembly 10 according to a particular embodiment is shown in FIG. 1. As may be understood from this figure, the bow stabilizing and shock dampening assembly 10 comprises an elongated housing 100, and an attachment mechanism 102 that extends from the proximal end of the housing 100. The attachment mechanism 102 is adapted for attaching (e.g., selectively attaching) the bow stabilizing and shock dampening assembly 10 to a bow 12 as shown, for example, in FIG. 8. In particular embodiments, the attachment mechanism 102 is a threaded rod. However, in other embodiments, the attachment mechanism 102 may be any other suitable mechanism for attaching the bow stabilizing and shock dampening assembly 10 to the bow 12.

As may be understood from FIG. 1, the elongated housing 100 is a substantially cylindrical structure that comprises: (1) a base portion 105; (2) a first dampener support 115 that is spaced a first distance apart from the base portion 105; (3) a second dampener support 125 that is spaced a second distance apart from the base portion 105; (4) a third dampener support 135 that is spaced a third distance apart from the base portion 105; and (5) a fourth dampener support 145 that is spaced a fourth distance apart from the base portion 105.

In various embodiments, the base portion 105 and each of the first, second, third, and fourth dampener supports 115, 125, 135, 145 are hollow rings, the centers of which are substantially co-linear. In particular embodiments, such as the embodiment of FIG. 1: (1) the distance between the third dampener support 135 and the fourth dampener support 145 is greater than (e.g., at least 20% greater than) the distance between the second dampener support 125 and the third dampener support 135; (2) the distance between the second dampener support 125 and the third dampener support 135 is greater than (e.g., at least 20% greater than) the distance between the first dampener support 115 and the second dampener support 125; and (3) the distance between the first dampener support 115 and the second dampener support 125 is greater than (e.g., at least 20% greater than) the distance between the base 105 of the elongated housing 100 and the first dampener support 115. In other embodiments, however, the dampener supports 115, 125, 135, 145 may be substantially evenly spaced apart and/or may be spaced apart in any other suitable arrangement.

In particular embodiments: (1) the base 105 of the elongated housing 100 is connected to the first dampener support 115 by a first connection portion 110: (2) the first dampener support 115 is connected to the second dampener support 125 by a second connection portion 120; (3) the second dampener support 125 is connected to the third dampener support 135 by a third connection portion 130; and (4) the third dampener support 135 is connected to the fourth dampener support 145 by a fourth connection portion 140.

As may be understood from FIGS. 1-6, in particular embodiments, the first, second, third, and fourth connection portions 110, 120, 130, 140 each comprise a plurality of (e.g., three) elongated connection members that are substantially parallel to the central axis of the elongated housing 100, and to each other. In the embodiment shown in FIG. 1, the three elongated connection members are spaced evenly apart about the outer circumference of the housing 10. In this embodiment, the elongated housing 10 defines an opening between each adjacent pair of connection members. As discussed in greater detail below, each of these openings is dimensioned to allow a user to pass a dampener 205, 215, 225, 235 from outside the housing 100, through the opening, and into the housing's interior 100.

As may be understood from FIG. 5, each of the first, second, third, and fourth dampener supports 115, 125, 135, and 145 is substantially in the form a hollow ring and defines a groove 117, 127, 137, 147 adjacent its interior surface. As discussed further below, each of these grooves 117, 127, 137, 147 is adapted to receive a portion of a respective dampener 205, 215, 225, 235, which serves to hold the dampener 205, 215, 225, 235 in place relative to the elongated housing 100.

In particular embodiments, the elongated housing 100 defines a substantially circular opening in the housing's distal end. As shown in FIGS. 5 and 6, this allows dampeners of different lengths to be supported by the fourth dampener support 145.

In various embodiments, the housing 100 is an elongated piece of metal that is generally in the form of a hollow cylinder. The hollow cylinder defines a plurality of cutouts in its sides and distal end. In other embodiments, the housing 100 may be made of one or more pieces of any other suitable material or combination of materials. For example, in particular embodiments, the respective dampener supports 115, 125, 135, 145 may be spaced apart and connected by lengths of a flexible material, such as rubber.

FIGS. 7A-7C depict dampeners 205, 205A, 205B according to three different embodiments. The dampener 205 of FIG. 7A comprises: (1) a rigid, substantially cylindrical central portion 206 (which may be made, for example, of metal or plastic); (2) a hollow cylindrical flexible outer portion 207 (which may be made of any suitable flexible material, such as rubber); and (3) a thin, ring-shaped outer lip 208 that extends about the circumference of the outer portion 207. In particular embodiments, the thickness of the lip 208 is about the same as the thickness of the respective grooves 117, 127, 137, 147 of the various dampener supports 115, 125, 135, 145. In a particular embodiment, the respective centers of the central portion 206, outer portion 207, and outer lip 208 are all substantially collinear and the dampener 205 is substantially symmetrical about its central axis.

The dampener 205A of FIG. 7B comprises a rigid, substantially cylindrical central portion 206A (which may be made, for example, of metal or plastic), and a hollow cylindrical flexible outer portion 207A (which may be made of any suitable flexible material, such as rubber). In particular embodiments, the thickness of the flexible outer portion 207A is about the same as the thickness of the respective grooves 117, 127, 137, 147 of the various dampener supports 115, 125, 135, 145.

The dampener 205B of FIG. 7C comprises a substantially spherical central portion 206B (which may be made, for example, of a rigid material, such as metal or rigid plastic, or a suitable flexible material), and a hollow cylindrical flexible outer portion 207B (which may be made of any suitable flexible material, such as rubber). In particular embodiments, the thickness of the flexible outer portion 207B is about the same as the thickness of the respective grooves 117, 127, 137, 147 of the various dampener supports 115, 125, 135, 145.

Exemplary Use of Bow Stabilizer and Dampening Assemblies

To use a bow stabilizing and shock dampening assembly 10 according to various embodiments, a user first positions one or more dampeners 205, 215, 225, 235 in place within the bow stabilizing and shock dampening assembly's elongated housing 100. For example, when using the bow stabilizing and shock dampening assembly 10 shown in FIGS. 1-5, a user: (1) positions the first dampener 205 in the bow stabilizing and shock dampening assembly's first dampener support 115; (2) positions the second dampener 215 in the bow stabilizing and shock dampening assembly's second dampener support 125; (3) positions the third dampener 225 in the bow stabilizing and shock dampening assembly's third dampener support 135; and (4) positions the fourth dampener 235 in the bow stabilizing and shock dampening assembly's fourth dampener support 145.

In this example, the first, second, and third dampeners 205, 215, 225 all have a structure that is similar to the dampener 205 shown in FIG. 7A. The fourth dampener 235 has a structure that is generally similar to the first, second, and third dampeners 205, 215, 225, except that the fourth dampener 235 has a center portion that is longer and heavier than the center portion of the first, second and third dampeners 205, 215, 225. This causes the fourth dampener 235 to be heavier than the first, second and third dampeners 205, 215, 225.

In the embodiment of FIGS. 1-5, a user may insert any of the various dampeners 205, 215, 225, 235 in place within the elongated housing 100 by: (1) squeezing the dampener 205, 215, 225, 235, which compresses the dampener's flexible outer portion and temporarily reduces the dampener's width; (2) inserting the dampener 205, 215, 225, 235 into the housing's interior through any suitable opening in the housing 100; (3) orienting the dampener 205, 215, 225, 235 so that it is positioned within a plane that is generally parallel to the sides of the housing 100; (3) while the dampener 205, 215, 225, 235 is in this orientation, moving the dampener 205, 215, 225, 235 toward the particular dampener support 115, 125, 135, 145 that will ultimately hold the dampener in place. The user then positions the dampener's circumferential outer lip 207, 217, 227, 237 within the groove 117, 127, 137, 147 defined by the particular dampener support 115, 125, 135, 145 until the outer lip 207, 217, 227, 237 snaps into place within the groove 117, 127, 137, 147 (and, in various embodiments, substantially matingly engages the interior portion of the dampener support 115, 125, 135, 145 that defines the groove 117, 127, 137, 147). In this configuration, the engagement between the dampener's outer lip 207, 217, 227, 237 and the dampener support 115, 125, 135, 145: (1) provides a flexible interface between the dampener 205, 215, 225, 235 and the dampener support 115, 125, 135, 145; and (2) maintains the dampener 205, 215, 225, 235 in a substantially fixed position and orientation while the dampener 205, 215, 225, 235 is installed on a bow, and while the bow is used to shoot an arrow.

To remove a dampener 205, 215, 225, 235 from the housing 100, a user may simply push the dampener 205, 215, 225, 235 out of engagement with the dampener support 115, 125, 135, 145, and then use their fingers to pull the dampener 205, 215, 225, 235 through a suitable opening in the housing 100.

As may be understood from the example above, in various embodiments, the bow stabilizing and shock dampening assembly 10 is adapted to allow users to, without tools, install dampeners 205, 215, 225, 235 into, and remove dampeners 205, 215, 225, 235 from, the bow stabilizing and shock dampening assembly's housing 100. This may, for example, allow users to quickly change the configuration of the bow stabilizing and shock dampening assembly 10.

For example, turning to FIG. 5, if a user wishes to move weight away from the end of the bow stabilizing and shock dampening assembly 10 and toward the middle of the assembly 10, a user may use the techniques described above to: (1) remove the third and fourth dampeners 225, 235 from the bow stabilizing and shock dampening assembly 10; (2) insert the fourth dampener 235 in the third dampener support 135; and (3) insert the third dampener 225 in the fourth dampener support 145. Similar techniques may be used to allow users to rearrange or remove the various dampeners (e.g., without tools) as desired. As an aside, it should be understood in light of the above that the bow stabilizing and shock dampening assembly 10 may be adapted for use without dampeners 205, 215, 225, 235 disposed in each of the bow stabilizing and shock dampening assembly's various dampener supports 115, 125, 135, 145.

Once the dampeners 205, 215, 225, 235 are in their desired positions within the bow stabilizer and dampening assembly's housing 100, the user may attach the bow stabilizing and shock dampening assembly 10 to a bow (e.g., by screwing a threaded distal end of the bow stabilizing and shock dampening assembly's attachment mechanism 102 into a threaded recess in a front surface of the bow.) FIG. 8 shows a particular example in which the bow stabilizing and shock dampening assembly 10 is installed adjacent a front surface of a bow 12. The user then uses the bow 12 in the traditional manner to shoot arrows.

As shown in FIG. 8, in particular embodiments, when the bow stabilizing and shock dampening assembly 10 is installed adjacent the bow 10: (1) the bow stabilizing and shock dampening assembly's various dampeners 205, 215, 225, 235 are substantially parallel to each other; (2) the respective centers of the bow stabilizing and shock dampening assembly's various dampeners 205, 215, 225, 235 are at least substantially co-linear (e.g., they are co-linear); (3) each of the dampeners 205, 215, 225, 235 is disposed within a plane that is substantially perpendicular to the plane of the bow 12; and (4) the dampeners 205, 215, 225, 235 engage the housing's dampener supports 115, 125, 135, 145 about at least a portion of the circumference (e.g., part, or the entire circumference) of the dampeners 205, 215, 225, 235.

Alternative Embodiments

The bow stabilizing and dampening assemblies described above may be provided in a variety of different lengths and configurations, and with a variety of numbers of dampeners and/or dampener supports. For example, the embodiment shown in FIG. 9 includes two dampener supports 105A, 125A that collectively support two different dampeners 205, 235.

As another example, the alternative embodiment of FIG. 10 includes a hollow flexible (e.g., rubber) housing 300 that defines a series of circumferential grooves that extend around the side portions of the housing as shown in FIGS. 10 and 11. The housing 300 defines a single dampener support 345 adjacent the distal end of the housing 300 for supporting a dampener 205A in the manner described above. In various embodiments, the distal end of the housing 300 is flared as shown in FIG. 10.

This bow stabilizing and shock dampening assembly 30 may be installed adjacent a bow (e.g., in the same general manner shown in FIG. 8) so that the bow stabilizing and shock dampening assembly's dampener is disposed within a plane that is substantially perpendicular to the plane of the bow. Also, in particular embodiments, the housing is adapted so that the dampener may be selectively removed from, or installed in, the housing 300 without tools.

Yet another embodiment of a bow stabilizing and shock dampening assembly is shown in FIGS. 12-13. In this embodiment, the bow stabilizing and shock dampening assembly 40 comprises an elongated housing 400 that includes a base portion 405, an end portion 435 and two dampener supports 415, 425 that are positioned between the base portion 405 and the end portion 435. The base portion 405, dampener supports 415, 425, and end portion 435 are attached together with suitable connecting members as shown in FIG. 12. In this embodiment, the end portion 435 also serves as a dampener support.

As may be understood from FIGS. 12 and 13, each of the dampener supports 415, 425, 435 defines a circular recess 418, 428, 438 that is dimensioned to receive a circular portion 507, 517, 527 of a dampener 505, 515, 525. Each of the dampener supports 415, 425, 435 further defines a hole (e.g. a relatively small, substantially circular hole) adjacent its center. This allows users to attach a suitable dampener 505, 515, 525 adjacent each of the respective dampener supports 415, 425, 435 by: (1) positioning the dampener 505, 515, 525 so that (a) a threaded rod at one end of the dampener 505, 515, 525 extends through the hole in the dampener support 415, 425, 435 and (b) a circular portion 507, 517, 527 of the dampener 505, 515, 525 is seated within the dampener support's circular recess 418, 428, 438 as shown in FIGS. 12 and 13; and (2) securing the dampener 505, 515, 525 in place adjacent the dampener support 415, 425, 435 by attaching a suitable nut 506, 516, 526 to the end of the threaded rod. This may be done either with the user's fingers, or with suitable tools (e.g., a wrench), depending on the particular embodiment.

It should be understood that, although the dampeners 505, 515, 525 are shown in FIGS. 12 and 13 as being attached to the dampener supports 415, 425, 435 by the combination of a threaded rod and a nut 506, 516, 526, any other suitable mechanical or chemical fastener may be used for this purpose.

Conclusion

Many modifications and other embodiments of the invention will come to mind to one skilled in the art to which this invention pertains having the benefit of the teachings presented in the foregoing descriptions and the associated drawings. For example, while the dampeners described above are described as being generally circular, other shapes and sizes of dampeners (and dampener supports) may be used in other embodiments. Also, it should be understood that the techniques and structures described above could be used in contexts other than archery. For example, the stabilizing and shock dampening assemblies may be attached to a rifle (or other type of firearm) to stabilize and reduce vibration in the rifle when the rifle is discharged. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What is claimed is:

1. A bow stabilizing and shock dampening assembly comprising:

a first dampener support;

a second dampener support that is spaced apart from said first dampener support;

a support structure that is adapted for connecting said first dampener support to said second dampener support; and an attachment mechanism that is adapted for attaching said bow stabilizing and shock dampening assembly to a bow, wherein said first and said second dampener supports are formed on an inner surface of the support structure, and the support structure is configured to define an open cavity intermediate said first and said second dampener supports when a dampener is inserted into each of said first and said second dampener supports.

2. The bow stabilizing and shock dampening assembly of claim 1, wherein:

said first dampener support is adapted to support a first dampener;

said second dampener support is adapted to support a second dampener; and said support structure, said first dampener support, and said second dampener support are adapted to cooperate to maintain said first and second dampers in a substantially fixed spatial relationship to each other while:

(A) said bow stabilizing and shock dampening assembly is attached to a bow; and (B) said bow is used to shoot an arrow.

3. The bow stabilizing and shock dampening assembly of claim 2, wherein said support structure, said first dampener support, and said second dampener support are adapted so that, when said first dampener is supported by said first dampener support and said second dampener is supported by said second dampener support:

said first dampener is disposed within a first plane;

said second dampener is disposed within a second plane; and said first plane is at least substantially parallel to said second plane.

4. The bow stabilizing and shock dampening assembly of claim 3, wherein said first plane is parallel to said second plane.

5. The bow stabilizing and shock dampening assembly of claim 3, wherein:

said first dampener is substantially circular;

said second dampener is substantially circular; and a center of said first dampener is substantially collinear with a center of said second dampener.

6. The bow stabilizing and shock dampening assembly of claim 3, wherein said first and second planes are substantially perpendicular to a plane of said bow when said bow stabilizing and shock dampening assembly is attached to said bow.

7. The bow stabilizing and shock dampening assembly of claim 3, wherein:

said bow stabilizing and shock dampening assembly comprises a substantially rigid housing that comprises said first dampener support, said second dampener support, and said support structure; and said housing defines an interior that is dimensioned to house:

(A) said first dampener, when said first dampener is supported by said first dampener support; and (B) said second dampener, when said second dampener is supported by said second dampener support.

8. The bow stabilizing and shock dampening assembly of claim 7, wherein:

said housing defines a plurality of cut outs that are disposed between said first dampener support and said second dampener support, each respective one of said plurality of cut outs being dimensioned for allowing the passage of said first dampener from outside of said housing, through said respective cut out, and into said interior of said housing.

9. The bow stabilizing and shock dampening assembly of claim 3, wherein:

said bow stabilizing and shock dampening assembly comprises a third dampener support that is spaced apart from said first and second dampener supports;

said second dampener support is disposed between said first and third dampener supports;

said second dampener support is spaced a first distance apart from said first dampener support;

said second dampener support is spaced a second distance apart from said third dampener support; and said first distance is at least 25% greater than said second distance.

10. The bow stabilizing and shock dampening assembly of claim 9, wherein said second dampener support is the only dampener support that is disposed between said first and third dampener supports.

11. The bow stabilizing and shock dampening assembly of claim 3, wherein:

said bow stabilizing and shock dampening assembly comprises at least one flexible member that links said first dampener support to said second dampener support.

12. The bow stabilizing and shock dampening assembly of claim 3, wherein:

said first dampener support is adapted to allow users to, without disassembling said assembly:

(A) selectively install a dampener within said first dampener support; and (B) selectively remove said dampener from said first dampener support;

said second dampener support is adapted to allow users to, without tools:

(A) selectively install said dampener within said second dampener support; and (B) selectively remove said dampener from said second dampener support.

13. The bow stabilizing and shock dampening assembly of claim 1, wherein said first and second dampener supports are adapted to cooperate to maintain said first and second dampeners in a spaced apart, co-facing relationship.

14. The bow stabilizing and shock dampening assembly of claim 1, wherein:

said bow stabilizing and shock dampening assembly comprises a substantially rigid housing that comprises said first dampener support, said second dampener support, and said support structure; and said housing defines an interior that is dimensioned to house:

(A) said first dampener, when said first dampener is supported by said first dampener support; and (B) said second dampener, when said second dampener is supported by said second dampener support.

15. The bow stabilizing and shock dampening assembly of claim 14, wherein:

said bow stabilizing and shock dampening assembly comprises a third dampener support that is spaced apart from said first and second dampener supports;

said second dampener support is disposed between said first and third dampener supports;

said second dampener support is spaced a first distance apart from said first dampener support;

said second dampener support is spaced a second distance apart from said third dampener support;

said first distance is at least 25% greater than said second distance; and said second dampener support is the only dampener support that is disposed between said first and third dampener supports.

16. The bow stabilizing and shock dampening assembly of claim 1, wherein:

said first dampener support is adapted to allow users to, without disassembling said assembly:

(A) selectively install a dampener within said first dampener support; and (B) selectively remove said dampener from said first dampener support;

said second dampener support is adapted to allow users to, without tools:

(A) selectively install said dampener within said second dampener support; and (B) selectively remove said dampener from said second dampener support.

17. The bow stabilizing and shock dampening assembly of claim 16, wherein said first and second dampener supports are each adapted to support dampeners of varying weights.

18. A bow stabilizing and shock dampening assembly comprising:

a first dampener support;

a second dampener support that is spaced apart from said first dampener support;

a support structure that is adapted for connecting said first dampener support to said second dampener support; and an attachment mechanism that is adapted for attaching said bow stabilizing and shock dampening assembly to a bow, wherein:

said first dampener support is adapted to support a first dampener by engaging at least a portion of a circumference of said first dampener;

said second dampener support is adapted to support a second dampener by engaging at least a portion of a circumference of said second dampener;

said first and said second dampener supports are formed on an inner surface of the support structure; and said first and second dampener supports are adapted to allow a user to selectively install and remove said first and second dampeners from said respective first and second dampener supports without disassembling said assembly.

19. The bow stabilizing and shock dampening assembly of claim 18, wherein:

said first dampener comprises a substantially rigid central portion that is surrounded substantially entirely by a flexible outer portion.

20. A bow stabilizing and shock dampening assembly comprising;

a first dampener support;

a second dampener support that is spaced apart from said first dampener support;

a support structure that is adapted for connecting said first dampener support to said second dampener support; and an attachment mechanism that is adapted for attaching said bow stabilizing and shock dampening assembly to a bow, wherein:

said first dampener support is adapted to support a first dampener by engaging said first dampener about substantially the entire outer circumference of said first dampener;

said second dampener support is adapted to support a second dampener by engaging said second dampener about substantially the entire outer circumference of said second dampener;

said first and said second dampener supports are formed on an inner surface of the support structure; and the support structure is configured to define an open cavity intermediate said first and said second dampener supports when a dampener is inserted into each of said first and said second dampener supports.

21. A bow stabilizing and shock dampening assembly comprising:

an elongated housing that is adapted to be selectively attached to a bow; and a dampener support formed in an interior of the housing that is adapted so that, when said bow stabilizing and shock dampening assembly is attached to said bow, said dampener support maintains a dampener in a plane that is substantially perpendicular to a plane of said bow, wherein said bow stabilizing and shock dampening assembly is adapted to allow a user to, without disassembling said assembly, selectively:

install a first dampener in said second dampener support; and install a second dampener in said first dampener support.

22. The bow stabilizing and shock dampening assembly of claim 21, wherein said elongated housing defines said dampener support.

23. The bow stabilizing and shock dampening assembly of claim 21, wherein said elongated housing comprises a flexible material.

24. The bow stabilizing and shock dampening assembly of claim 21, wherein:

said dampener support is a first dampener support;

said dampener is a first dampener;

said bow stabilizing and shock dampening assembly comprises a second dampener support that is adapted so that, when said bow stabilizing and shock dampening assembly is attached to said bow, said second dampener support maintains a second dampener in a plane that is substantially perpendicular to a plane of said bow.

25. The bow stabilizing and shock dampening assembly of claim 21, wherein said first and second dampeners weigh different amounts.

26. A weapon stabilizing and shock dampening assembly comprising:

an elongated housing that is adapted to be selectively attached to a weapon, said weapon being selected from a group consisting of a bow and a firearm;

a plurality of dampener supports that, when said elongated housing is selectively attached to said weapon, are adapted to maintain a plurality of dampeners in place at varying distances from a particular surface of said weapon; and at least one opening positioned intermediate two adjacent dampener supports of said plurality of dampener supports and formed through said elongated housing side wall, wherein said at least one opening is configured to allow a dampener to be inserted or removed from a respective one of the plurality of dampener supports.

27. The weapon stabilizing and shock dampening assembly of claim 26, wherein said elongated housing defines said plurality of dampener supports.

28. The weapon stabilizing and shock dampening assembly of claim 26, wherein each of said plurality of dampener supports is adapted so that, when said weapon stabilizing and shock dampening assembly is attached to said weapon, each of said dampener supports maintains a dampener in a plane that is substantially perpendicular to a plane of said weapon.

29. The weapon stabilizing and shock dampening assembly of claim 28, wherein each respective one of said plurality of dampener supports is adapted to allow users to, without disassembling said assembly, selectively install dampeners into, and selectively remove dampeners from, said respective dampener support.

30. The weapon stabilizing and shock dampening assembly of claim 29, wherein said weapon is a bow.

* * * * *